United States Patent [19]

Matsui et al.

[11] Patent Number: 5,012,212

[45] Date of Patent: Apr. 30, 1991

[54] OPEN RESONATOR FOR ELECTROMAGNETIC WAVES HAVING A POLARIZED COUPLING REGION

[75] Inventors: Toshiaki Matsui, Tokyo; Kenichi Araki, Nara, both of Japan

[73] Assignee: Communications Reseach Laboratory Ministry of Posts and Telecommunications, Koganei, Japan

[21] Appl. No.: 255,019

[22] Filed: Oct. 7, 1988

[30] Foreign Application Priority Data

Oct. 7, 1987 [JP] Japan ..... 62-251469

[51] Int. Cl.[5] ..... H01P 7/06

[52] U.S. Cl. ..... 333/227; 333/230; 333/995

[58] Field of Search ..... 333/227, 219, 230, 995; 331/79

[56] References Cited

U.S. PATENT DOCUMENTS 3,676,808 7/1972 Vinogradov ..... 333/227
4,109,233 8/1978 Erickson ..... 342/27 X

FOREIGN PATENT DOCUMENTS 553697 6/1977 U.S.S.R. ..... 333/219
1169049 7/1985 U.S.S.R. ..... 333/227

OTHER PUBLICATIONS

Amity, I; "A Fabrg-Perot Cavity for mm and Sub-mm ESR Spectrometers"; *The Review of Scientific Instruments;* vol. 41, No. 10; Oct. 1970; pp. 1482-1494.

Culshaw, W; "High Resolution mm-Wave Fabrg-Perot Interferometer"; *IRE Transaction on Microwave Theory and Technique;* Mar. 1960; pp. 182-189.

*Primary Examiner*—Benny Lee

*Attorney, Agent, or Firm*—Oblon, Spivak, McClelland, Maier & Neustadt

[57] ABSTRACT

An open resonator comprises two concave spherical reflectors or one spherical and one plane reflectors positioned so as to form a resonant structure and each being provided at an electromagnetic coupling region thereof with a large number of conductor stripes disposed in parallel at a spacing sufficiently small in comparison with the wavelength of an incident electromagnetic wave. The diameter of the circular coupling region can be made very large in comparison with the wavelength. An ultra-high Q value can be obtained with the open resonator with very high excitation efficiency to a resonator mode. The Q value of the open resonator can be varied with the angle between the directions of the conductor stripes of the two reflecting mirrors.

8 Claims, 12 Drawing Sheets

OPEN RESONATOR FOR ELECTROMAGNETIC WAVES HAVING A POLARIZED COUPLING REGION

BACKGROUND OF THE INVENTION

1. Field of the Invention

This invention relates to an open resonator for electromagnetic waves and more particularly to an open resonator formed by two concave spherical reflectors or one spherical and one plane reflector and applicable to electromagnetic waves of a frequency equal to or higher than the frequency of microwaves, which enables realization of a high Q value, a high excitation efficiency of the resonator mode and, when necessary, adjustment of the Q value, these features being achieved by taking advantage of the fact that a surface constituted of parallel stripes of a metal (or superconductor) having high electrical conductivity exhibits strong reflection characteristics with respect to polarized electromagnetic waves having an electric field parallel to the stripes and that very weak coupling of the electromagnetic waves through the grid surface established at the center portion of each mirror can be selectively adjusted by varying the width of the metal (or superconductor) stripes, the intervals between the stripes and the dimensional ratio of these to the wavelength.

2. Prior Art Statement

An ideal, loss-free resonator would be able to store the energy of an electromagnetic wave that enters it by maintaining the wave in a state of perpetual oscillation. Attempts have been made to apply the principle of resonators to precision measurement of ultra-low loss materials and to high-sensitivity detection of trace components in the atmosphere. In fact, however, existing resonators are not loss free and, therefore, the electromagnetic energy stored in the resonator decreases with the passage of time. The amount of electromagnetic energy dissipated per unit time in a resonator at any given time is proportional to the amount of energy stored in the resonator at that time. For evaluating a resonator, therefore, there is usually used a quality factor referred to as the Q value which is obtained by dividing the product of the angular frequency of the electromagnetic wave and the energy stored in the resonator by the energy dissipated per second in the resonator at the instant concerned. In the case where electromagnetic energy in the resonator is accumulated by the constant energy flow through the coupling with an electromagnetic wave, the electromagnetic energy stored in the resonator becomes saturated at the time the energy being dissipated therefrom becomes equal to the energy of the electromagnetic wave being supplied thereto, whereafter the energy stored in the resonator remains constant. Therefore, the lower the loss of the resonator, the greater is the amount of energy that can be stored therein. Thus a resonator with low loss has a large Q value. If it should be possible to control the resonator loss, it would be possible to set the resonance characteristics at the required Q value.

FIGS. 1 to 3 show examples of conventionally used optical resonators and FIGS. 4(*a*) and 4(*b*) show examples of waveguide-coupled millimeter-wave resonators. These will be explained first.

FIG. 1 illustrates an open resonator constituted of two plane partially-transparent mirrors disposed in parallel. When a plane wave 1 impinges on the plane partially-transparent mirror 3 on the incidence side, a part of the electromagnetic energy of the incident plane wave 1 enters the region between the parallelly placed plane mirrors 3 and 4, and is thus superimposed on itself by being repeatedly reflected back and forth between the two mirrors. The energy 5 is stored in the resonator most efficiently when the frequency of the incident wave is equal to the resonant frequency determined by the distance between the plane mirrors 3 and 4. In this case, as a result of the interference between the repeatedly reflected waves, the excitation efficiency of the open resonator with the incident wave 1 becomes maximum, whereby the amount of energy 5 stored in the resonator also becomes maximum. As a result, the energy flowing rate of the transmitted plane wave 2 likewise becomes maximum.

In the case of an open resonator using an incident beam of a finite beam diameter, as shown in FIG. 1, the plane parallel to the resonator suffers from two major disadvantages which prevent the resonator from having a high Q value. Namely, (1) the diffraction loss increases at the reflector edges and makes a precise theoretical knowledge of field distribution more difficult and (2) precise alignment is required.

Replacement of at least one of the plane reflectors by a concave reflector is advantageous in focusing the field into a small volume. Therefore, if apertures of the reflectors are large enough to render field intensities at their rims negligible, the diffraction loss becomes negligible and parallelism between the reflectors is not strictly required.

As shown in FIG. 2, if one or both of the partially-transparent mirrors 3' and 4' have concave spherical surfaces, an advantage of calculability without resorting to sophisticated computational techniques can be additionally obtained. In this case, the orthogonal modes prove to be the well-known Gaussian beam modes which are found in laser and maser cavities. Part of the incident beam 1 passes through the spherical partially-transparent mirror 3', whereby coupling is realized. When the frequency of the incident beam 1 is equal to a resonant frequency of the resonator, the energy 5 stored in the resonator becomes maximum as does the electromagnetic energy flow of the transmitted beam 2.

FIG. 3 shows a spherical mirror type open resonator having two spherical mirrors 6 and 7 with respective coupling holes 8 and 9 at the centers thereof. The spherical mirrors 6 and 7 are placed so as to form a resonant structure. The electromagnetic energy of the incident beam 1 transmits through the coupling hole 8 of the spherical mirror 6 into the resonator preformed with the two mirrors 6 and 7, whereby coupling is realized. When the frequency of the beam 1 is equal to a resonant frequency of the resonator, the energy flow of the transmitted beam 2 becomes maximum.

FIGS. 4(*a*) and 4(*b*) show conventional waveguide-coupled millimeter-wave resonators. In FIG. 4(*a*), a spherical mirror 6 and a plane mirror 7' are placed so as to form a resonant structure. Two small coupling holes 8 and 9 fabricated near the center of the spherical mirror 6 are used to transmit the energy to and from the input and output waveguide, in which input energy 11 and output energy 12 propagate. An input energy 11 is transmitted through the coupling hole 8 of the spherical mirror 6 into the resonator and the component thereof reflected in the axial direction by the plane mirror 7' facing the spherical mirror 6 is thus superimposed on itself by being repeatedly reflected between the two mirrors. The energy 5' stored in the resonator increases, causing the output energy 12 transmitting through the coupling hole 9 to increase. When the total energy dissipated per unit time in the resonator becomes equal to the energy flow rate into the resonator mode, a state of equilibrium is reached.

FIG. 4(*b*) shows an example in which the plane mirror 7' of the resonator of FIG. 4(*a*) is replaced with a spherical mirror 7 having a small coupling hole 9. The operation of this resonator is substantially the same as that of FIG. 4(*a*).

With the arrangements of the conventional open resonators shown in FIGS. 1 to 4, it is extremely difficult to control the loss of the resonator so as to obtain the desired Q value. Adjustment of the coupling strength of a resonator with a high Q value has been particularly difficult because the loss is set at a very weak level in such resonators, which makes it necessary to control the coupling strength under conditions of a weak coupling strength, which has been virtually impossible because of the limitations of fabrication technology.

Attachment of partially-transparent metallic thin films 13 as shown in FIG. 5(*a*) on the opposed surfaces on the mirrors 3 and 4 and 3' and 4' of FIG. 1 or FIG. 2 has also been adopted in place of the formation of the coupling hole in the mirror as shown in FIG. 4. In this case, a partially-transparent metallic thin film 13 is formed to have a small-transparency characteristic and a high-reflection characteristic by adjusting the thickness, etc., of the thin film. Furthermore, use of a latticed metallic film 14 of FIG. 5(*b*) or a porous metallic film 15 of FIG. 5(*c*) in place of the partially-transparent metallic thin film 13 of FIG. 5(*a*) has been proposed. The transparency and reflection characteristics are adjusted by varying the pattern in the case of FIG. 5(*b*) and by varying the void content in the case of FIG. 5(*c*).

With these films, however, it is very difficult to selectively control the reflection to become very high and the transparency to become very small. Particularly, the transparency varies depending on slight difference in thickness or pattern of a film and, therefore, it is very difficult to obtain films with the same degrees of reflection and transparency characteristics with high reproducibility.

The coupling holes 8 and 9 in the mirrors 6 and 7 should preferably be of large diameter for effective introduction of the input energy 1 or 11 into the resonator. However, for realizing a resonator with a high Q value it becomes necessary to make the coupling strength exceptionally weak. Thus the diameter of the coupling hole is usually made smaller than the wavelength. In the case of microwaves of a low frequency below 10 GHz, adjustment of the coupling strength is relatively easy from a technical point of view because the wavelength is long.

However, in the case of 2–3 mm electromagnetic waves, differences in fabrication precision or in the manner in which the surfaces are finished have a great effect on the distribution of the electric field of the high frequency waves, making it impracticable to achieve the subtle control of the coupling strength required in an open resonator at the millimeter and submillimeter wave frequencies.

For realizing a resonator with a high Q value, in addition to establishing a very weak coupling between the inside and outside of the resonator, it is also important to take into consideration how the resonator excitation signal can be efficiently converted into the resonator mode. How the conversion loss during resonator mode excitation varies depending on the coupling method will now be explained with reference to FIG. 6.

As shown in FIG. 6(*a*), the highest efficiency is obtained in the case of the open resonator constituted using a spherical partially-transparent mirror as denoted by reference numeral 16. By conducting the excitation using a signal beam which has been adjusted to a beam 17 that is very close to the mode 18 in the resonator, the beam 17 can be converted to the resonator mode 18 with high efficiency. On the other hand, as shown in FIG. 6(*b*), in the case of an open resonator constituted of two spherical mirrors 19 having respective very small coupling holes 20, at the time the converged incident beam 17 passes into the resonator through one of the small coupling holes 20 it is strongly diffracted and is diffused within the resonator at a large solid angle. However, of the coupled wave, only the component 21 traveling substantially in the direction of the optical axis is stored as the energy of resonator mode TEMooq, and most of the electromagnetic energy 24 escapes to the outside of the open resonator. The situation is exactly the same in the case of the waveguide-coupled open resonators with small coupling holes shown in FIGS. 4(*a*) and 4(*b*), and it is a major defect of these resonators that this conversion loss comes on top of and is added directly to the transmission loss of the resonator.

FIG. 14 is a graph corresponding to the case where a plane wave enters an open resonator according to FIG. 1 which is constituted of loss-free parallel plane mirrors and exhibits the transmission characteristics of an ideal Fabry-Perot resonator in which the diffraction loss, resistive loss at the mirror surfaces and the scattering loss are negligible. Where the incident wave is an electromagnetic wave of a finite beam diameter, this corresponds to the case of carrying out ideal conversion to resonator mode of an incident beam such as that in FIG. 6(*a*) in the open resonator of FIG. 2 which uses spherical partially-transparent mirrors in place of plane mirrors for avoiding diffraction loss or in an open resonator wherein one of the spherical mirrors is replaced with a plane mirror placed at the center of the two spherical mirrors.

In the graph of FIG. 14, the transmittance for different reflectances R of the mirrors indicating the ratio of signal power P2 of the transmitted electromagnetic wave to the signal power P1 of the incident electromagnetic wave is represented on the vertical axis and the phase difference $\delta$ caused by passage back and forth between the mirrors is represented on the horizontal axis. When this phase difference $\delta$ becomes equal to an integral multiple of $2\pi$, i.e. when the difference in the length of the optical paths becomes equal to an integral multiple of the wavelength, resonance occurs and the transmittance P2/P1 assumes the maximum value 1. The sharpness of the resonance increases as the reflectance R of the mirrors becomes higher, making it possible to obtain a large Q value, while the maximum value of the transmittance is constant. When the phase difference $\delta$ is not equal to an integral multiple of $2\pi$, the transmittance P2/P1 decreases with the increase in surface reflectance R. However, in actual practice, because of the finite loss in the resonator, the transmittance decreases gradually at higher Q values.

FIG. 15 is a schematic representation of the actual transmission characteristics of a millimeter wave open resonator with small coupling holes. As shown in FIG.

15, the sharpness of the resonance increases as the coupling hole of the mirror becomes smaller, making it possible to obtain a large Q value, while the maximum value of the transmittance P2/P1 is considerably reduced. At microwave frequency or millimeter wave frequency of several tens of GHz, sharp resonance, i.e. a high Q value, can be obtained by making the diameter of the coupling holes small. However, the high Q value achieved by this method is obtained at the expense of a large reduction in the excitation efficiency of the resonator, making it difficult to realize an S/N ratio on the order required for precision measurement using an open resonator with a very high Q value.

While the waveguide-coupled open resonator is the only type used for millimeter waves below the range of several tens of GHz, a high Q open resonator with very small coupling holes usually has large transmission loss of 20 to 30 dB. Most of the input signal power is lost to the outside of the resonator.

Open resonator technology is applied in conjunction with laser resonators for a broad range of wavelengths extending from light to microwaves, as well as in conjunction with scanning Fabry-Perot wavelength meters and widely in the field of spectrometry in connection with bandpass filters. Moreover, as this technology can enable the realization of resonators for use in the millimeter and sub-millimeter wave regions, it is also used in precision measurement of ultra-low loss materials and trace substances.

Generally speaking, variation of the resonant frequency of an open resonator can be easily realized by changing the distance between the mirror surfaces. However, it has not been possible to vary the Q value. The realization of an open resonator which, in addition to being variable in its resonant frequency characteristics, also allows free selection of its Q value over a wide range would provide many practical advantages.

OBJECT AND SUMMARY OF THE INVENTION

An object of this invention is to provide an open resonator for electromagnetic waves which has a high Q value, a high excitation efficiency and enables fine adjustment of its Q value.

For realizing this object, the present invention provides an open resonator for electromagnetic waves comprising two spherical mirrors, or one spherical mirror and one plane mirror, having selective reflection characteristics with respect to linear polarized waves and being provided with openings of a diameter sufficiently large to reduce the effect of diffraction loss to a negligible level, the two mirrors being placed face to face to allow an electromagnetic wave to be repeatedly reflected therebetween as superposed on itself and also being set with a small angular difference between the direction of their polarizing reflectors, and the variation in the effective reflectance of the respective mirror surfaces obtained by adjusting this angular difference being utilized to continuously adjust the Q value of the resonance.

The above and other objects and features of the invention will become more apparent from the following detailed description with reference to the accompanying drawings.

BRIEF DESCRIPTION OF THE DRAWINGS

FIG. 4(*b*) is sectional schematic view of another example of a conventional wave-guide coupled type open resonator.

FIG. 5(*b*) is an explanatory view of a latticed metallic film attached to the mirror surface of a conventional open resonator.

FIG. 5(*c*) is an explanatory view of a porous metallic film attached to the mirror surface of a conventional open resonator.

FIG. 6(*b*) is an explanator view illustrating the state in which the mode of an incident beam of a conventional resonator using a coupling hole is converted into the resonator mode.

FIG. 6(*c*) is an explanator view illustrating the state in which the mode of an incident beam of the resonator according to the present invention is converted into the resonator mode.

FIG. 19(*b*) is a graph showing the narrow transmission band characteristics of the filter of FIG. 18.

DETAILED DESCRIPTION OF THE PREFERRED EMBODIMENT

The principle of the invention relating to an open resonator with spherical reflectors each having a circular metal grid for electromagnetic wave coupling will first be explained with reference to FIGS. 7 to 10. This invention takes advantage of the fact that a conductor-grid surface consisting of conductor (metal or superconductor) stripes placed in parallel at a prescribed pitch has strong selective reflection characteristics with respect to polarized eletromagnetic waves, that such a reflecting mirror surface exhibits a particularly high reflectance when the plane of polarization of the incident electromagnetic waves is parallel to the conductor stripes, that the weak transmittance of such a reflecting mirror surface can be selectively varied by choosing the width of the stripes, the size of the intervals between the stripes, and the dimensional ratio between these and the wavelength, whereby it becomes possible by microlithographic techniques to fabricate and adjust an extremely weak coupling area using the partially-transparent mirror surface established at the center portion of a concave spherical reflector, and that the effective reflectance of such a mirror surface for a coupling area depends on the angle between the direction of polarization of the incident wave and the direction of conductor stripes of the mirror, whereby it becomes possible to fine-adjust the reflectance by adjusting said angle.

Figure 7A:
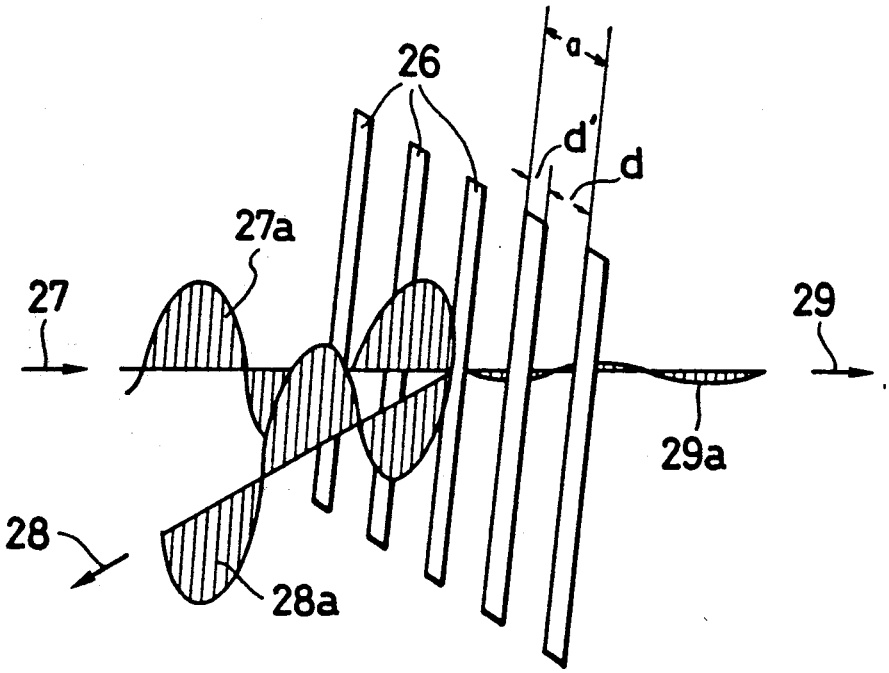
FIGS. 7(*a*) and 7(*b*) are illustrations for explaining the polarized wave reflection and transmission characteristics of thin parallel conductor-grids.
Figure 7B:
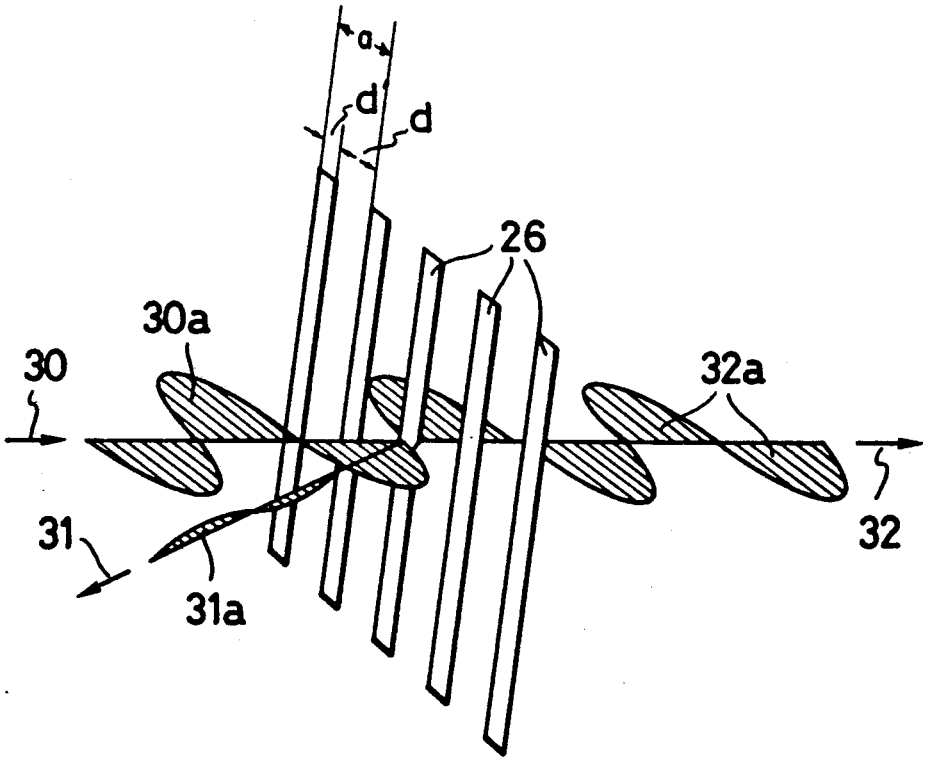

More specifically, as shown in FIG. 7(*a*), conductor stripes 26 with sufficiently low surface resistance characteristics are placed in parallel at a prescribed pitch. When the conductor stripes 26 are irradiated by an electromagnetic wave 27 having a plane of polarization 27*a* parallel to the conductor stripes 26, high-frequency current flows in the conductor stripes 26. If, in this case, the metal grid consists of parallel conductor stripes 26 having very low surface resistance and arranged at intervals d sufficiently small in comparison with the wavelength λ of the incident electromagnetic wave 27, the surface consisting of the conductor stripes 26 exhibits a high reflectance similar to that of a uniform, smooth metallic surface with a high electrical conductivity. As a result, almost all of the incident electromagnetic wave is reflected by the conductor stripes 26 and the amplitude of the reflected wave 28 of the plane of polarization 28*a* is substantially the same as the amplitude of the incident electromagnetic wave. The amplitude of the transmitted wave 29 of the plane of polarization 29*a* that has passed through the intervals between the conductor stripes 26 is very much smaller than the amplitude of the reflected wave 28.

On the other hand, when the conductor stripes 26 are irradiated with an electromagnetic wave 30 having a plane of polarization 30*a* which is normal to the conductor stripes 26, as shown in FIG. 7(*b*) no high-frequency current is induced at the surface of the conductor stripes 26 so that nearly 100% of the electromagnetic wave passes through the intervals between the conductor stripes 26. As a result, the amplitude of the transmitted wave 32 of the plane of polarization 32*a* is almost exactly the same as the amplitude of the incident electromagnetic wave 30. The amplitude of the reflected wave 31 of the plane of polarization 31*a* is much smaller than the amplitude of the transmitted wave 32.

The sharp reflection characteristics with respect to polarized electromagnetic wave mentioned in the foregoing can be realized by actually arranging conductor stripes having very low surface resistance in parallel at intervals which are sufficiently small in comparison with the wavelength of the incident electromagnetic wave.

Figure 16:
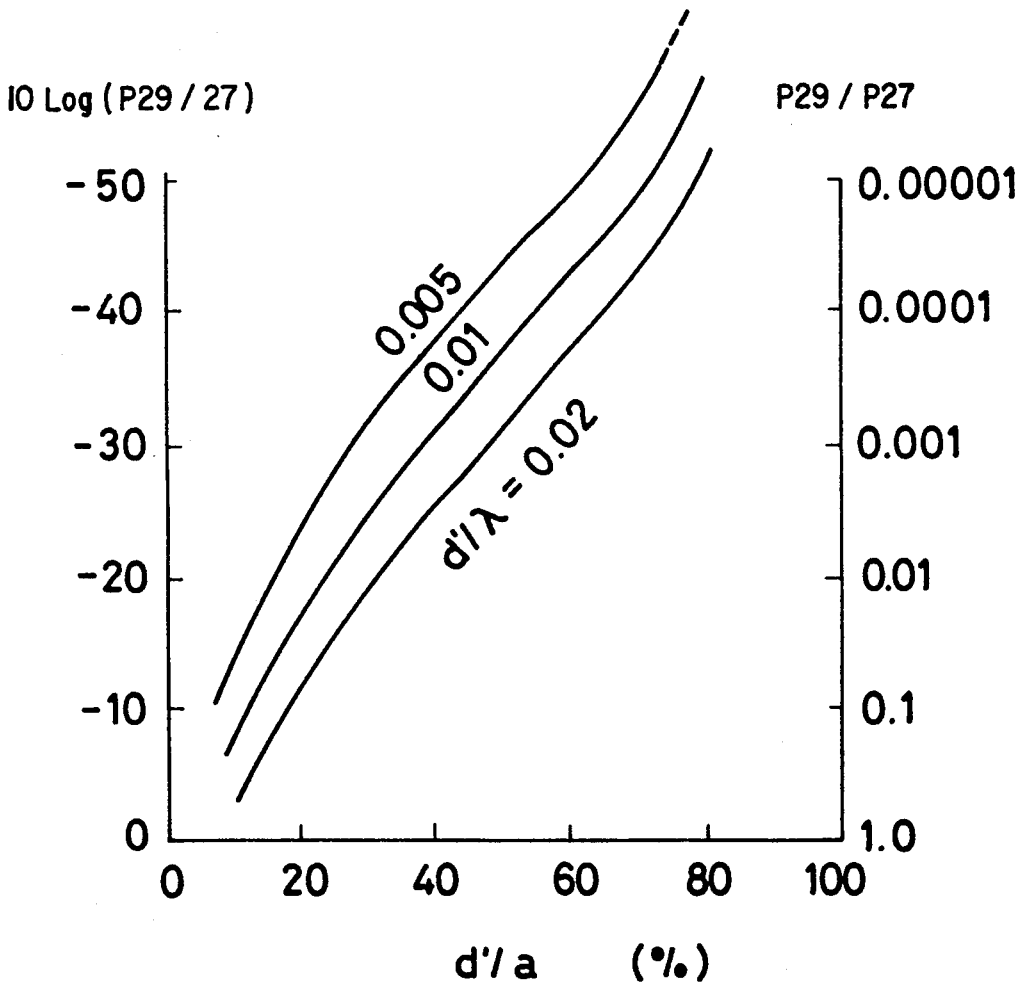
FIG. 16 is a graph showing the transmission characteristics of the plane wave being polarized with its E vector parallel to the direction of conductor-stripes.

The graph of FIG. 16 shows how the weak transmittance given as a ratio of the transmitted power P29 to the incident power P27 varies in the case where, as illustrated in FIG. 7(*a*), the polarized electromagnetic wave 27 falls incident on a zero-thickness reflection surface with its plane of polarization aligned with the direction of the conductor stripes 26. The graph is based on data obtained by an approximation with respect to a plane wave. In this graph, the horizontal axis represents the percentage of metal strips in the grid surface, where the symbol d' denotes the width of each strip and a the sum of the width d' and the spaced d between adjacent strips, as shown in FIGS. 7(*a*) and 7(*b*). The vertical axes represent the transmittance P29/P27 on a log scale, and numbers on the right and left axes are given by decimal and dB, respectively. The calculated transmittance P29/P27, i.e. $d'/\lambda=0.02$, 0.01 or 0.005, is shown for indicating the case of sufficiently small ratio of the width of the strip to the wavelength. The very weak transmittance of 0.001 to 0.00001 can be obtained when an open space ratio is about 50%. The smaller the wavelength λ is in relation to the width d' of the conductor stripes and the smaller the ratio of the width d of the spaces between the stripes to the width d' of the stripes (the open-space ratio), the smaller is the ratio of the transmitted power P29 of the transmitted wave 29 (the output power) to the incident power P27 of the incident wave 27. While the graph of FIG. 16 relates to the results for a plane wave, it can be presumed that a Gaussian beam would exhibit the same basic tendency. When the film thickness of the mirror surface is selected to be several times the skin depth, the transmittance is determined by the pattern of the conductor stripes. This pattern can relatively easily be formed with good reproducibility by using microlithographic techniques.

Figure 8:
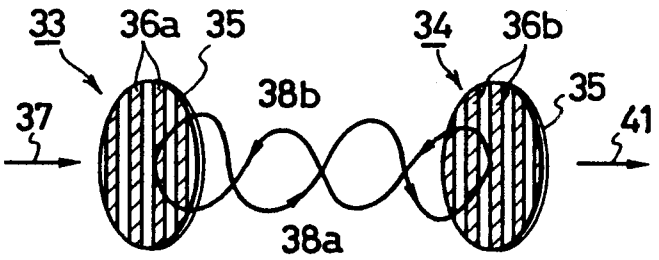
FIG. 8 is an illustration for explaining the principle of the open resonator according to this invention.

The reflection of the polarized wave between two mirrors having reflection characteristics with respect to polarized electromagnetic waves will now be explained. As shown in FIG. 8, the resonator is formed by two polarizing reflectors (mirros) 33 and 34 constituted by arranging conductor stripes 36*a* or 36*b* on a transparent substrate 35. The description of the diffraction loss with reference to FIGS. 8, 9 and 10 has been omitted in the interest of simplicity. The two reflectors 33 and 34 are positioned in parallel to each other axis as separated by a prescribed distance.

Figure 10A:
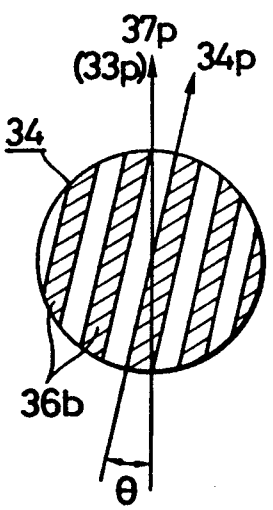
FIGS. 10(*a*) and 10(*b*) are illustrations for explaining the state of reflection of electromagnetic waves at the reflecting mirror on the transmission side.
Figure 10B:
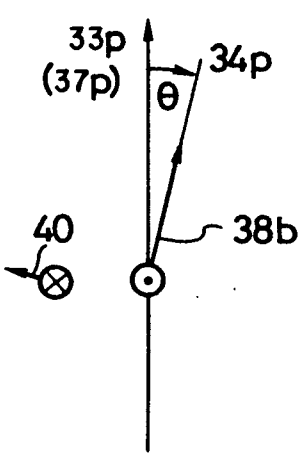
Figure 9B:
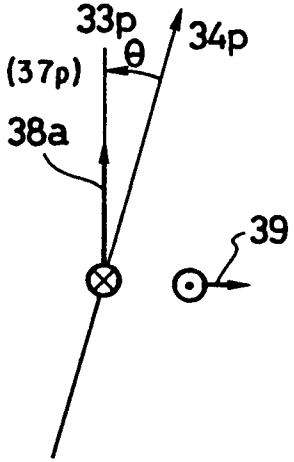
FIGS. 9(*a*) and 9(*b*) are illustrations for explaining the state of reflection of electromagnetic waves by a reflecting mirror on the incidence side.
Figure 9A:
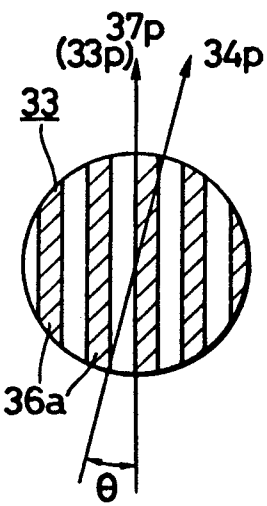

If, as shown in FIG. 9(*a*) and FIG. 10(*a*), the mirror 33 on the transmission side is positioned such that the direction of its conductor stripes 36*b* make a small angle θ with respect to the direction of disposal of the conductor stripes 36*a* of the mirror 33 on the incidence side and with the mirrors in this state, an electromagnetic wave 37 (see FIG. 8) is directed onto the mirror 33 with its plane of polarization 37*p* aligned with the direction of disposal 33*p* of the conductor stripes 36*a*, then, similarly to what is shown in FIG. 7(*a*), almost all components of the incident electromagnetic wave 37 will be reflected by the conductor stripes 36*a* and only a very small portion of the components will transmit into the resonator through the gaps between the conductor stripes 36*a* of the mirror 33. This small portion, constituting a coupled wave 38*a* with a plane of polarization 37*p*, will travel in the direction of the mirror 34. Of the coupled wave 38*a* reaching the mirror 34, only the polarized wave portion parallel to the direction of disposal 34*p* of the conductor stripes 36*b* of the mirror 34 is reflected by the mirror 34 and the reflected wave 38*b* returns to the mirror 33. The polarized wave component 40 of the coupled wave 38*a* which is normal to the aforesaid component passes through the mirror 34 and escapes to the exterior of the resonator. See FIGS. 10(*a*) and 10(*b*). Of the reflected wave 38*b* returning to the mirror 33 only the polarized wave component 39 normal to the direction of disposal 33*p* of the conductor stripes 36*a* passes through the mirror 33 and escapes to the exterior of the resonator. See FIG. 9(*b*). The polarized component parallel to the direction of disposal 33*p* is reflected in the direction of the mirror 34.

Thus, in the aforesaid manner, with each reflection from the mirrors 33 and 34, the plane of polarization of the electromagnetic wave changes alternately between the directions of disposal 33*p* and 34*p* of the reflecting conductor stripes 36*a*, 36*b*. With each reflection from one of the reflecting surfaces the amplitude of the electromagnetic wave is attenuated relative to that when the angle between the directions of the conductor stripes is zero by an amount proportional to the cosine of the difference angle $\theta$. The reflectance of the incident power of the electromagnetic wave is attenuated in proportion to the square of the cosine of the difference angle $\theta$. Therefore, when the resonator is constituted by disposing face to face two polarized electromagnetic wave mirros having high reflectances, then if the frequency of the incident wave 37 is the same as the resonant frequency determined by the distance between the mirrors 33 and 34, the small wave increments coupled through the mirror 33 will become superposed on each other, whereby the energy stored in the resonator will build up to the point of saturation. As a result, the transmitted output 41 from the mirror 34 will reach maximum. As will be clear from the foregoing explanation, by varying the angle between the two mirrors constituting the resonator over a small range it becomes possible to fine-adjust the effective reflectance of the mirror surfaces. If the polarizing reflector surface constituted of parallel conductor stripes is established in the center of each spherical mirror surface of an open resonator with a high Q value and negligible diffraction loss, the Q value of the open resonator can be continuously regulated by the fine adjustment of the effective reflectance of the mirror.

When the spherical mirror resonator is constituted using a circular coupling portion constituted of conductor stripes in this manner, it becomes possible to set the slight transmittance of a partially-transparent mirror surface with high reflectance as close to the target value as is permitted by the reproducibility of the fine processing used in the fabrication of the mirror surface. Moreover, it also becomes possible to fine-adjust the high Q value of the resonator by varying over a narrow range the difference angle $\theta$ between the directions of disposal of the conductor stripes of the two mirrors.

Figure 6A:
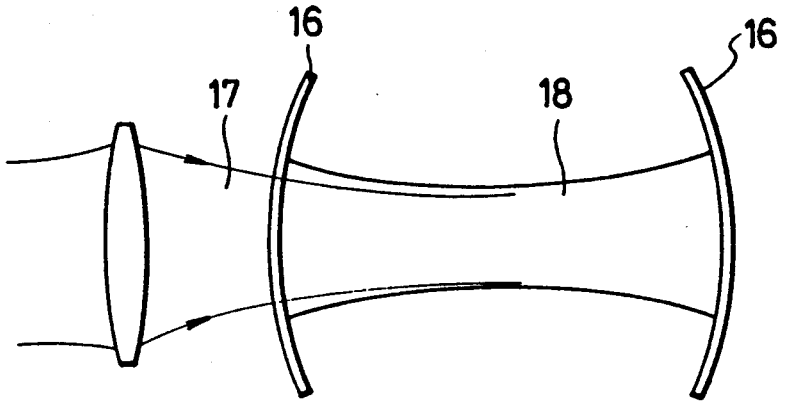
FIG.6(a) PRIOR ART
FIG. 6(*a*) is an explanator view illustrating the state in which the mode of an incident beam of a conventional resonator using a spherical reflection mirror is converted into the resonator mode.
Figure 6B:
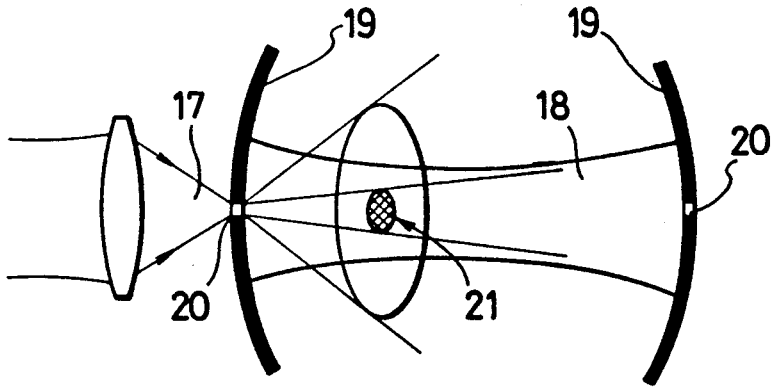
FIG.6(b) PRIOR ART
Figure 6C:
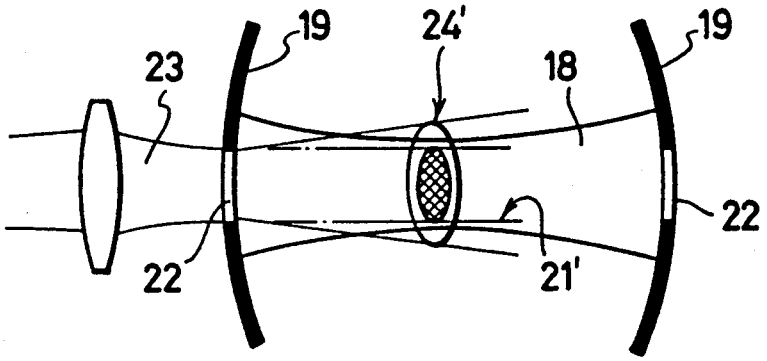

In this way, an improvement can be realized in the resonator excitation efficiency, which has constituted another major problem in the open resonator. In the conventional method of realizing a high Q value in an open resonator by using small coupling holes, most of the signal power is not effectively used for resonator mode excitation. As will be understood from FIG. 6(*b*), the low excitation efficiency of the beam 17 for the resonator mode 18 is the result of the fact that since the incident electromagnetic wave passes through a small coupling hole 20 of a diameter smaller than its wavelength, the resulting strong diffractive effect disperses the signal energy over a wide solid angle 24 within the resonator so that most of it does not enter the resonator mode 18. As shown in FIG. 6(*c*), this drawback is overcome by forming in the center of each spherical mirror surface 19 a circular aperture of a partially-transparent polarizing reflector 22 of a diameter the same as or slightly smaller than the beam diameter on the mirror surface 19 of the resonator mode 18. With this arrangement, when the beam 23 is supplied with its diameter adjusted to that of the polarizing mirror surface 22 constituting the coupling portion, as compared with the case of using the small coupling holes 20 of FIG. 6(*b*) a greater percentage of the component 24' which couples with the interior of the open resonator is accounted for by the component 21' which is effectively converted into the resonator mode 18 TEMooq.

A concrete example of the open resonator according to the invention will now be explained.

Figure 11:
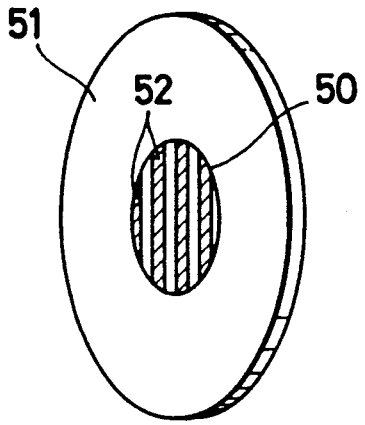
FIG. 11 is a perspective view of an example of a spherical mirror with a circular metal grid for electromagnetic wave coupling for an open resonator in accordance with this invention.

The open resonator was constituted using two spherical reflecting mirrors of the type illustrated in FIG. 11. Each spherical mirror consisted of an optically polished spherical glass substrate 51 measuring 80 mm in diameter and having a radius of curvature of 200 mm, the concave surface of which was formed with a 1.5 μm-thick metal film. The metal film can be formed either by sputtering or by vacuum evaporation. To provide a weak coupling region, the center portion of the reflecting mirror was formed as a circular aperture of partially-transparent mirror 50 measuring 16 mm in diameter and consisting of gold film stripes 52 measuring 63 μm in width and separated from each other by 63 μm gaps. Formation of the stripes can be carried out by use of photo-lithography together with an ion milling process.

Figure 12:
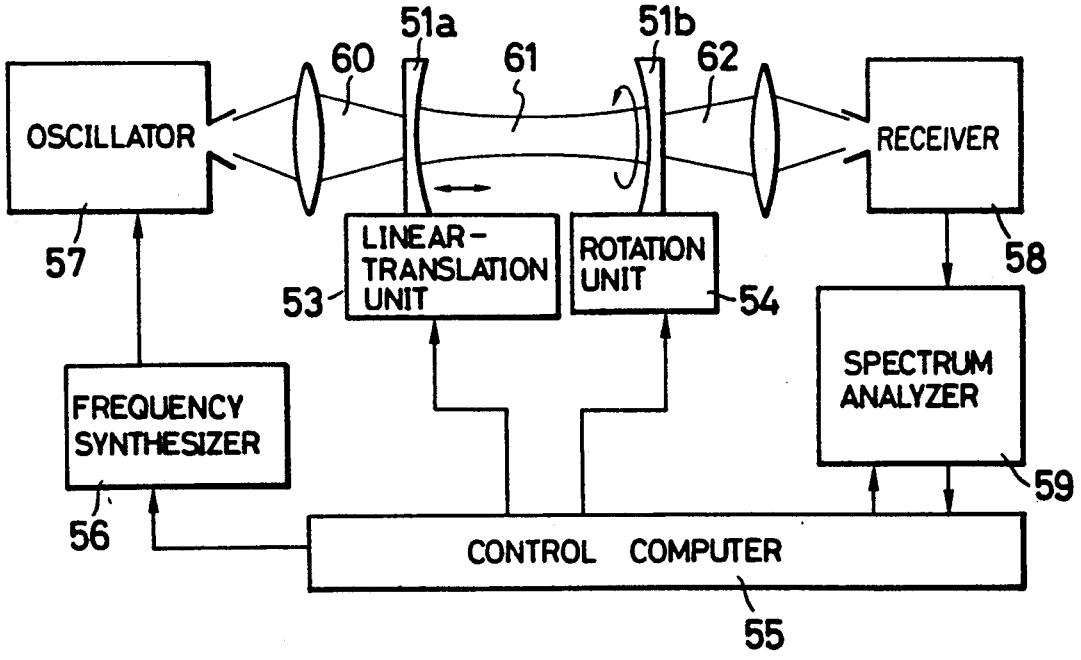
FIG. 12 is a schematic view of the experimental setup of an open resonator according to this invention.

FIG. 12 shows a schematic view of basic structure of the open resonator.

Spherical reflecting mirros 51*a* and 51*b* are placed to face one another with their optical axes coincident. The spherical reflecting mirror 51*a* on one side is supported on a linear-translation unit 53 so as to be movable back and forth along the optical axis. The spherical mirror 51*b* is supported on a rotation unit 54 so as to be rotatable about the optical axis. The rotation angle of the spherical mirror 51*b* is detected and output as a signal by an encoder (not shown).

Adjustment of the distance between the reflecting mirrors 51*a*, 51*b* is carried out by the linear-translation unit 53 on the basis of a signal received from a control computer 55.

A signal source with high frequency stability and spectral purity is required for measurement with an open resonator having a high Q value. When the Q value of the resonator exceeds about $10^5$, it becomes practically impossible to measure the resonator characteristics by translating one of the mirrors to vary the distance between the reflecting mirrors. Therefore there is used a method wherein the resonator length is set in the vicinity of an intended resonant frequency and the frequency of the probe signal is swept around the resonant frequency. The frequency of the probe signal is stabilized by a stable reference oscillator. In measurement with the open resonator shown in FIG. 12, the frequency generated by an oscillator 57 can be swept while being maintained at a stability of not less than $1\times10^{-9}$ by a signal from a frequency synthesizer 56, and the minimum frequency step width is 100 Hz. Therefore, this system is in principle capable of measuring Q values of $10^7$ to better than 1%. Where the resonator length is set and the frequency of the oscillator is swept, the energy 61 in the resonator is gradually increased by the incident beam 60 as the oscillator frequency approaches the resonator frequency, which also causes the transmitted signal 62 to increase. The transmitted signal 62 enters a receiver 58 and is analyzed by a spectrum analyzer 59. When the frequency of the oscillator 57 becomes the same as the resonant frequency, the energy 61 stored in the resonator becomes maximum and so does the transmitted signal 62.

Figure 13:
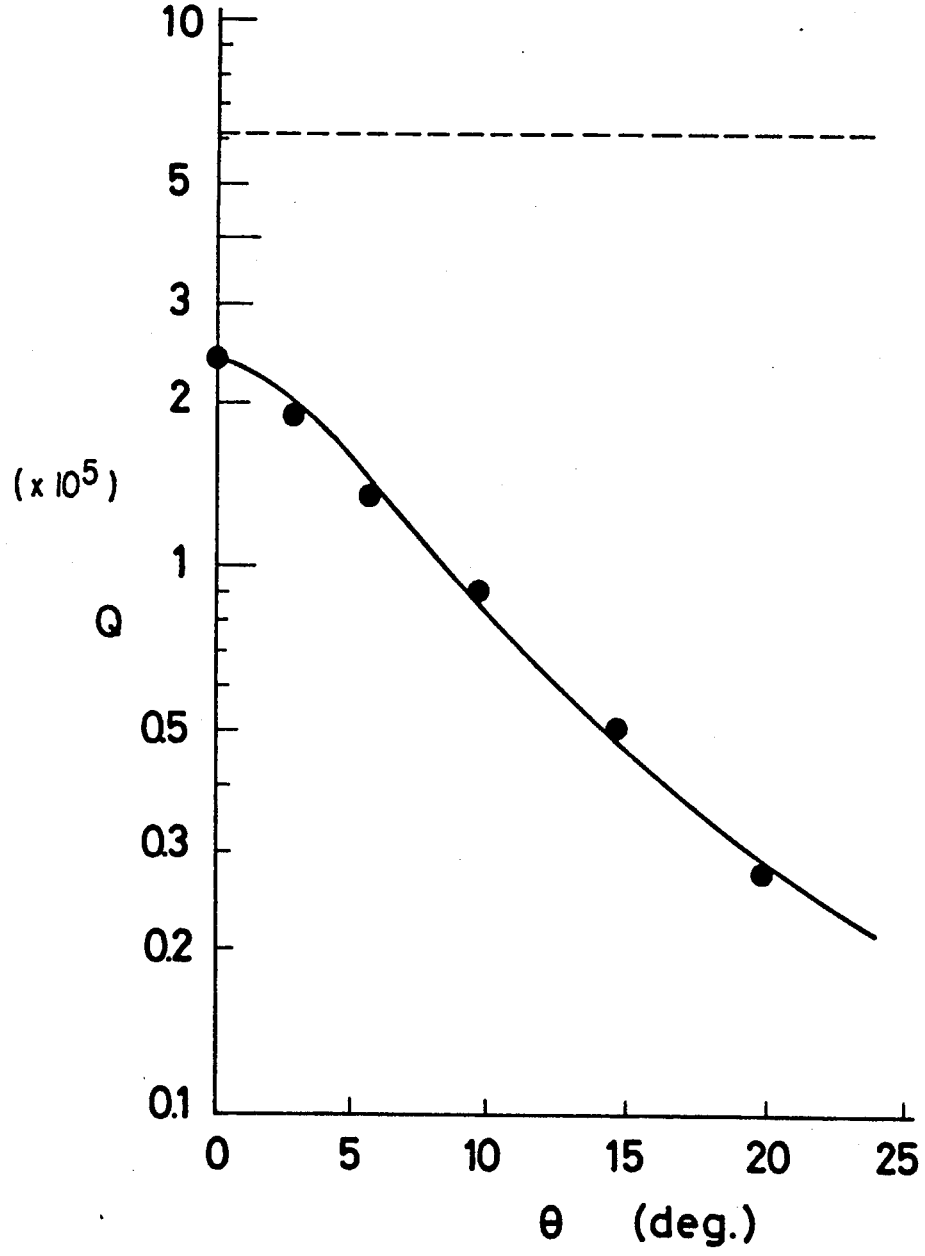
FIG. 13 is a graph showing the relationship between the rotation of a mirror and the change in Q value of a resonator according to this invention.

Using the open resonator of the foregoing description, the interval between the reflecting mirrors was set at 280 mm and the resonator characteristics were measured by conducting precision frequency scanning in the vicinity of a signal frequency of 105.9 GHz. The variation in the Q value with variation of the difference angle $\theta$ between the angles of the conductor stripes on the surfaces of the two reflecting mirrors was measured as shown in FIG. 13. When the directions of the conductor stripes were aligned, namely, when the difference angle $\theta$ was zero, the Q value became approximately $2.4\times10^5$, while at a difference angle of 15 degrees the Q value fell to around $5\times10^4$. The diameter (16 mm) of the coupling region formed of the conductor stripes was smaller than the diameter of the beam on the spherical surface, and about ½ of the total reflected power was measured at each reflection from the region or polarized reflecting mirrors, meaning that about half the incident power affects the change in reflectance caused by change in the difference angle $\theta$. As a result, the dependence on angle was weaker than in the case where the conductor stripes are provided over the whole mirror surface. The solid dots in FIG. 13 indicate test data and the solid line curve shows the result of a calculation making use of the effective reflectance obtained taking into consideration the power ratio between the reflected wave from the polarized reflecting mirror region at the center of the mirror surface and the reflected wave from the surrounding region. The experimental and calculated results are in good agreement.

The broken line in the figure indicates the Q value limit calculated taking into account only the ohmic loss of gold at room temperature. The experimentally obtained Q value reached 40% of the theoretical limit in the case of using gold reflecting mirrors. By employing identical gold reflecting mirrors having a coupling region in which the intervals between the conductor stripes is further reduced, it becomes possible to realize a Q value exceeding $5\times10^5$ and approaching the limit determined by the ohmic loss of the gold film. Further, by cooling the resonator to reduce the ohmic loss of the film surface, it is possible to obtain a Q value of $10^6$ to $10^8$, and where a superconducting thin film is used, a Q value of greater than $10^8$ becomes feasible.

The width of the conductor stripes and the size of the spaces therebetween can be easily controlled using thin film microlithographic techniques, meaning that the method of this invention is potentially applicable also to resonators in the sub-millimeter wave range.

Moreover, the measurement system according to this invention was easily able to realize an S/N ratio of more than 60 dB as against a 10 mW output from the oscillator 57, thus verifying that the resonator mode excitation efficiency was greatly improved over that of the conventional waveguide-coupled type resonator.

Next, concrete applications of the open resonator according to the invention will be discussed.

An explanation will first be given regarding the realization of an open resonator with an ultra-high Q value in the milliliter to sub-millimeter wavelength region. At the center region of each of the two reflecting mirrors of the open resonator, which may be two spherical mirrors or one spherical mirror and one plane mirror, there is provided a coupling mirror region constituted of parallel conductor stripes the width of each of which is sufficiently small in comparison with the wavelength and formed with a circular coupling aperture the diameter of which is large in comparison with the wavelength. An ultra-high Q value is achieved by utilizing and controlling the very weak transmission characteristics of the reflecting mirrors with respect to a wave polarized parallel to the direction of the conductor stripes on the mirror surfaces. At the same time, there is also realized a great improvement in the resonator mode excitation efficiency over the low efficiency which has been a serious defect of the conventional system employing a small coupling holes.

The spherical mirrors used for the aforesaid reflecting mirrors are fabricated from spherical mirror substrates that are transparent to millimeter and sub-millimeter waves and that are optically polished to obtain a substrate surface with high spherical precision and smoothness. The mirror surface of each substrate is formed with a high purity thin film of a highly conductive metal such as gold or aluminum by sputtering or vapor deposition in a vacuum. There is thus obtained a mirror surface with high reflectance with respect to electromagnetic waves. Since these reflecting mirrors are used for handling electromagnetic wave energy in the transmission mode, mirror substrates polished on both sides are used. The suitability of the substrate material increases as its transparency increases and its loss decreases, with respect to the electromagnetic waves. As materials for actual use, quartz, sapphire and the like are appropriate. It is also possible to use a glass substrate, which exhibits a relatively low loss characteristics with respect to low frequency millimeter waves.

So that the effect of direct transmission of the electromagnetic waves through the thin film can be ignored, there is secured a thickness of the film constituting the reflecting mirror surface which is several times the skin depth. In actual practice, thickness of greater than around 1 $\mu$m is required for millimeter waves.

Alternatively, there can be used a superconducting thin film of such as niobium or niobium alloy so as to realize a superconducting open resonator of an ultra-high Q value of $10^7$ to $10^{10}$ at very low temperatures.

The center portion of the spherical mirror substrate is provided with a circular mirror surface region exhibiting selective reflection characteristics with respect to polarized waves. This region is formed of parallel conductor stripes of a sufficiently small stripe width in comparison with the wavelength used and serves as a very weak coupling region according to the invention. The precision processing of this region is carried out such as by fine-patterning a resist film using photolithographic techniques and etching away the unnecessary portions by the ion milling method.

When the surface film of the reflecting mirrors has sufficient thickness and sufficiently low surface resistance, the weak transmittance with respect to a linearly polarized wave of which the polarization direction is coincident with the direction of the conductor stripes can, as shown in FIG. 16, be further reduced by reducing the ratio of the stripe width to the wavelength and reducing the ratio of the gap width to the stripe pattern pitch.

When the spherical mirrors formed with high-quality niobium film mirror surfaces are used, it becomes possible, by selecting the stripe pattern, to obtain a transmittance of not more than around $10^{-6}$, to realize a millimeter wave open resonator with a Q value of $10^9$ or greater.

Figure 3:
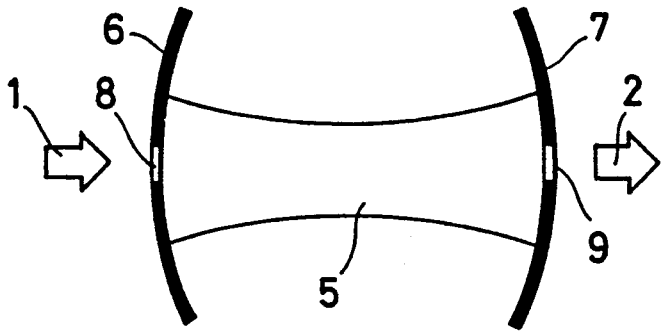
FIG.3 PRIOR ART
FIG. 3 is a sectional schematic view for explaining a conventional type open resonator with coupling holes.
Figure 4A:
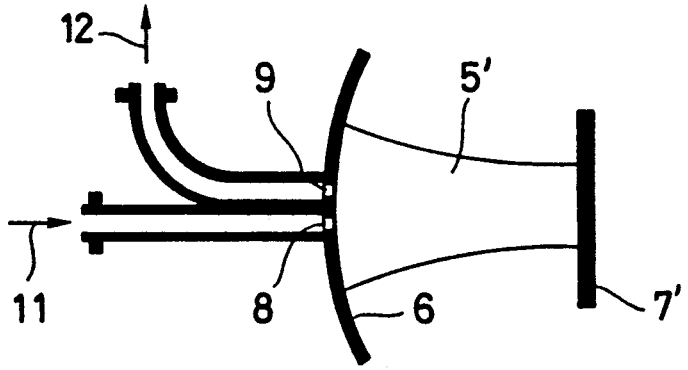
FIG.4(a) PRIOR ART
FIG. 4(*a*) is a sectional schematic view of one example of a conventional waveguide coupled type open resonator.
Figure 4B:
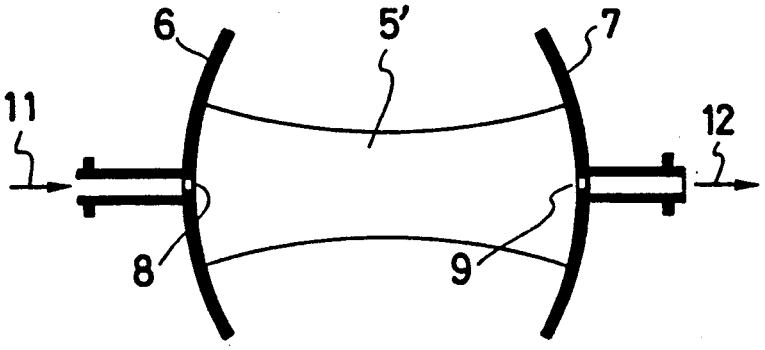
FIG.4(b) PRIOR ART
Figure 5A:
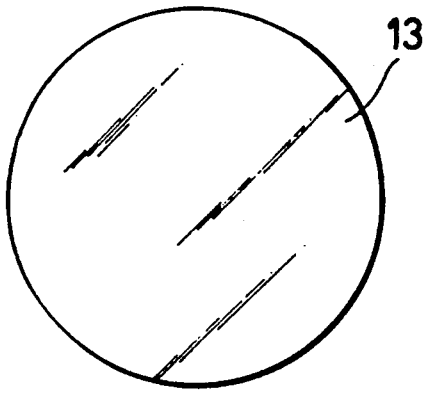
FIG.5(a) PRIOR ART
FIG. 5(*a*) is an explanatory view of a partially-transparent film attached to the mirror surface of a conventional open resonator.
Figure 5B:
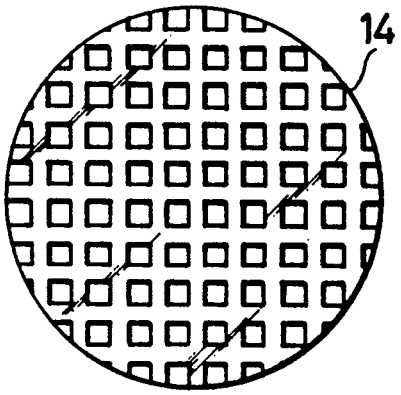
FIG.5(b) PRIOR ART
Figure 5C:
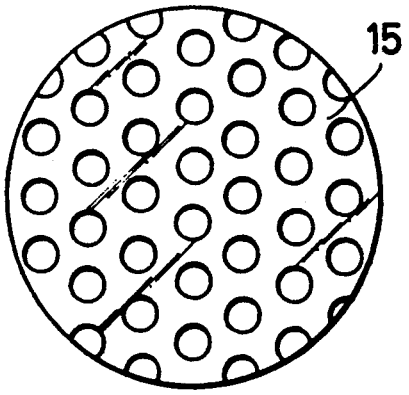
FIG.5(c) PRIOR ART

In this case, the diameter of the mirrors is set to be more than around three times the beam diameter on the reflecting mirrors, whereby the influence of the diffraction loss arising with repeated reflection between the reflecting mirrors can be ignored. This beam diameter on the reflecting mirrors is determined by the radius of curvature of the spherical mirrors, the distance between the two reflecting mirrors facing each other on the same optical axis, and the wavelength at that time. The diameter of the circular weak coupling region at the center portion of the reflecting mirrors is set to be the same as or slightly smaller than the beam diameter on the mirror surface.

Where the set-up conditions for an open resonator are sufficiently close to ideal and the resonator losses are very small, the Q value of the resonator is considered to be highly sensitive to the difference angle $\theta$ as well as change in the coupling Q caused by error in the difference angle. Thus in an open resonator with a Q value of $10^6$ or greater, if the weak coupling region having polarized reflection characteristics is made somewhat small so that only a part of the beam in the resonator is affected by the polarized reflecting surface, it will become possible to secure an appropriate overall $\theta$ dependency for practical application. Since it is also possible in this case to set the diameter of the aperture of the weak coupling region to be sufficiently large relative to the wavelength, the excitation efficiency of the resonator mode TEMooq will be much improved over that of an open resonator employing small coupling holes as shown in FIGS. 3 and 4.

When a substance is present in a resonator, there is a repeated mutual interaction between the substance and the electromagnetic wave. Thus if the resonator has a high Q value, even a very weak phenomenon will be amplified and made detectable due to this repeated mutual interaction. As a result, the resonator can be used as a very powerful means for heretofore difficult precision measurement of the physical constants of ultra-low loss materials including solid materials, liquids and gases, and also to detect trace components in the atmosphere.

In this case, the real part $\epsilon'$ of the dielectric constant of a substance in the open resonator can be determined from the shift in the resonant frequency between the case where the resonator is empty and the case where the substance being tested is present in the open resonator, and moreover the loss, i.e. the imaginary part $\epsilon''$ of the dielectric constant, can be obtained by precision measurement of the Q values in the said two cases of the open resonator.

Figure 14:
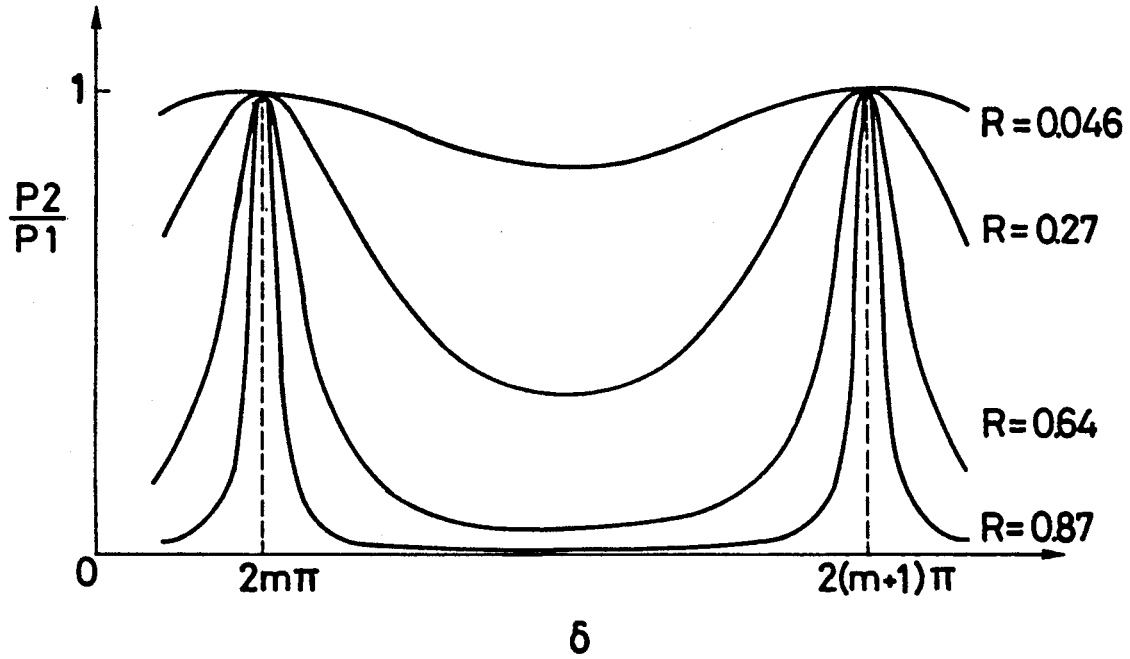
FIG. 14 PRIOR ART
FIG. 14 is a graph showing the transmission characteristics of an ideal Fabry-Perot resonator.
Figure 15:
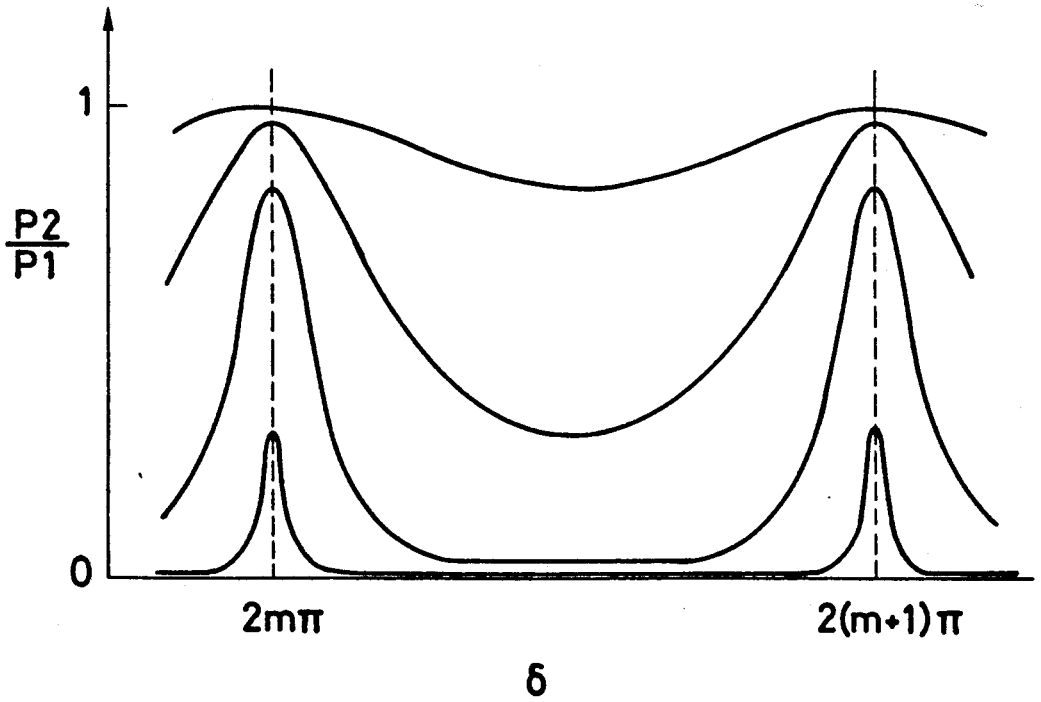
FIG. 15 PRIOR ART
FIG. 15 is a schematic representation of the transmission characteristics of an open resonator with coupling holes.

As an indicator of the resolution of a Fabry-Perot resonator there is used the finesse F. The finesse is defined as $F=\pi R^{\frac{1}{2}}/(1-R)$, where R is the reflectance of the mirror surface. This corresponds to the ratio of the distance between adjacent peaks such as shown in FIGS. 14 and 15 to the width of the transmission band. Where a high Q value is realized and the actual Q value is $10^6$ or higher, the finesse F can be considered to be $10^4$ or higher. Even where $F=10^4$ is presumed, this means that in the case of searching for a first resonance point, the probability of finding a resonance point is, in the simplest case, once in $10^4$ steps. This is the amount of work that must be done merely for finding a resonance point prior to starting the precision measurement and is likely to take a minimum of 1 to 3 hours. In a measurement using the ultra-high Q open resonator according to this invention, the Q value of the resonator can be lowered by a prescribed amount without shifting the resonant frequency by rotating one of the reflecting mirrors about the optical axis. As will be clear from FIG. 14, it becomes easier to locate a resonance peak in proportion as the finesse F becomes smaller. After a resonance peak has been detected, the reflecting mirror is rotated in the opposite direction by the same angle that it was rotated for lowering the Q value so that the original Q value is restored. The resonance peak can then easily be detected by carrying out measurement at a higher resolution only in the vicinity of the resonance point, whereby the efficiency of the precision measurement can be greatly upgraded.

Next an explanation will be given on how the open resonator according to the present invention can be used to realize a scanning Fabry-Perot wavelength meter.

Figure 1:
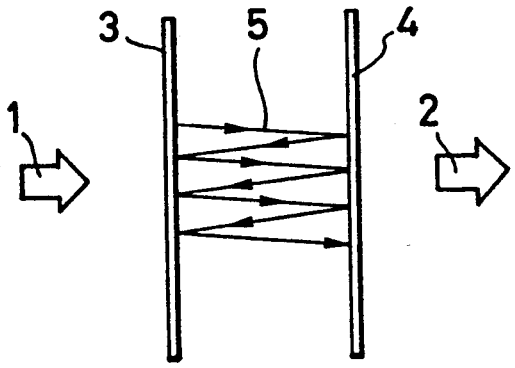
FIG. 1 PRIOR ART
FIG. 1 is a schematic view for explaining a conventional parallel plane mirror type open resonator.
Figure 2:
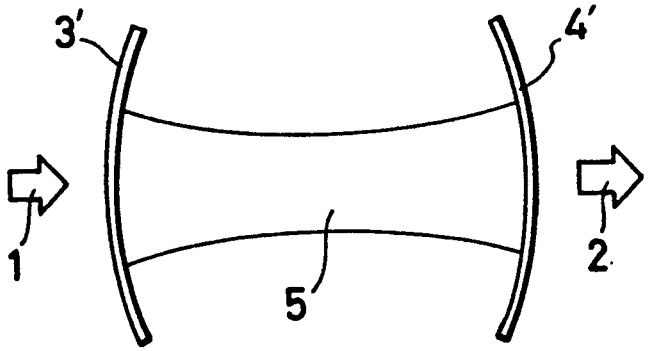
FIG. 2 PRIOR ART
FIG. 2 is a schematic view for explaining a conventional spherical mirror type open resonator.
Figure 17:
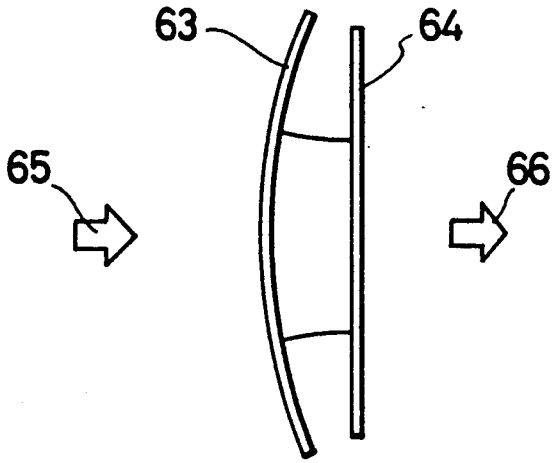
FIG. 17 is a sectional schematic view for explaining a wavelength meter employing the open resonator according to this invention.
Figure 18:
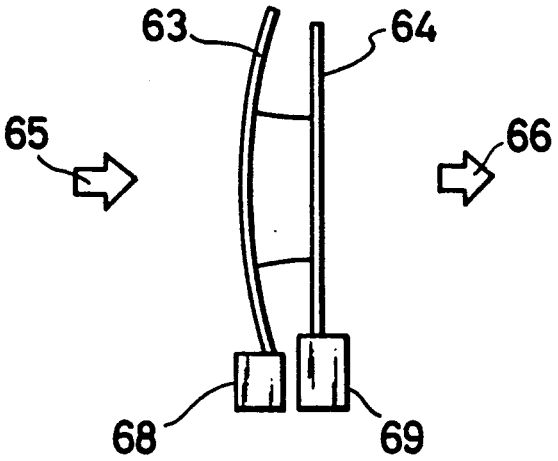
FIG. 18 is a schematic view for explaining a frequency- and band-variable filter employing the open resonator according to this invention.

In a Fabry-Perot wavelength meter, there is usually used a parallel plane mirror type open resonator such as shown in FIG. 1. However, use of this type of resonator is disadvantageous in that the diffraction loss is large for a finite diameter beam of microwaves and millimeter waves and further in that maintenance of a small diffraction loss of electromagnetic wave beam in and above the 200 to 300 GHz frequency range requires increasingly precise alignment of the parallel plane mirrors with increasing shortness of the wavelength, so that in either case the influence of the diffraction loss on the overall Q value is large and it becomes difficult to realize a high Q value. In the Fabry-Perot wavelength meter according to the present invention, on the other hand, one of the two parallel plane mirrors of FIG. 1 is, as shown in FIG. 17, replaced by a spherical mirror 63 with a large radius of curvature, and the respective reflecting mirrors 63 and 64 are provided with parallel conductor stripes the width of each of which is sufficiently small in comparison with the wavelength of an input beam 65, thereby to secure a high reflectance. These reflecting mirrors are placed facing each other on a common optical axis. Peaks of a transmission beam will be observed at resonance conditions. As shown in FIG. 18, the reflecting mirror 63 is supported on a translation unit 68 so as to be movable along the optical axis and the reflecting mirror 64 is mounted on a rotation unit 69 so as to be rotatable about the optical axis.

When the aforesaid arrangement is used, the Q value is governed primarily by the reflectance of the mirrors and can be varied by varying the difference angle $\theta$ between the directions of the conductor stripes of the two reflecting mirrors and there is realized a Fabry-Perot wavelength meter whose resonant frequency can be freely set.

In an open resonator, as the distance between the reflecting mirrors is varied, resonance peaks occur in the transmission characteristics with each $2\pi$ phase difference which arises once each time the distance between the reflecting mirrors changes by a half wavelength as shown in FIG. 14. Thus in the scanning Fabry-Perot wavelength meter, the wavelength analysis is carried out based on the interval between these peaks of the transmission beam 66. If the resonance characteristics are extremely sharp and so the finesse F becomes too large. It thus becomes necessary to increase the resolution of the reflecting mirror interval scanning steps for wavelength measurement, which may cause the time required for the measurement to become inappropriately long. In contrast, if the finesse F is too low, the resolution in the wavelength analysis will be insufficient. Thus for realizing efficient analysis, it is necessary to set the sharpness of the resonance, namely the finesse F, at an appropriate level.

When a wavelength meter of the structure shown in FIG. 18 is used, the finesse F can be varied as required, making it possible to utilize optimum spectral analysis conditions over a wide range of wavelengths extending from the millimeter wave region to the sub-millimeter wave region.

There will now be discussed a Q value-variable filter which is a new application of the open resonator according to the present invention.

As an application of the open resonator, there can be mentioned a frequency-variable band filter which capitalizes on the resonance frequency selectivity of the resonator and is applicable to frequency selection at the microwave to sub-millimeter wave frequency region.

Figure 19A:
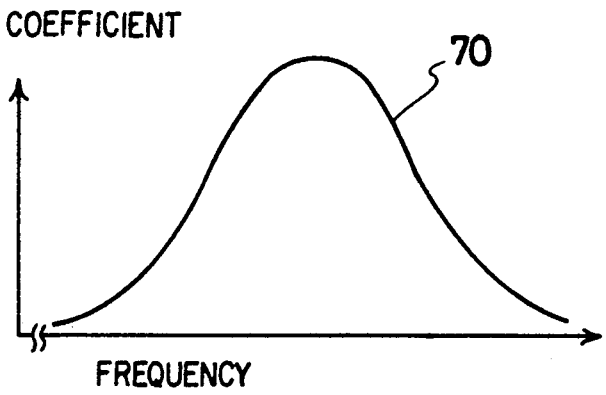
FIG. 19(*a*) is a graph showing the broad transmission band characteristics of the filter of FIG. 18.
Figure 19B:
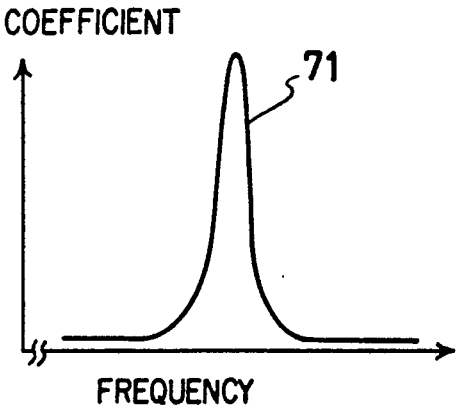
Figure 20A:
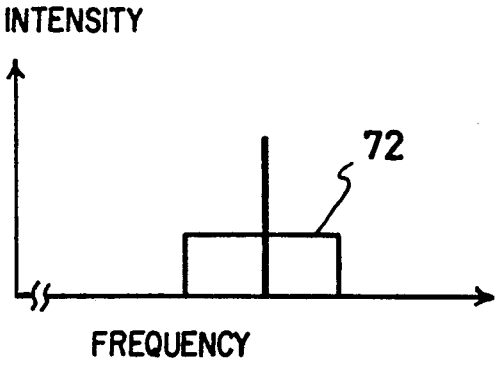
FIGS. 20(*a*) and 20(*b*) show the spectral characteristics of signals to be filtered.
Figure 20B:
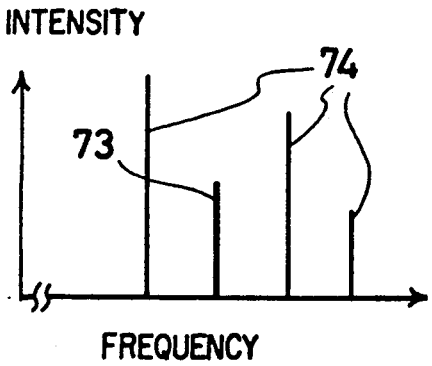

Like the aforesaid conventional scanning Fabry-Perot wavelength meter, the conventional wavelength-selectable Fabry-Perot filter also uses the parallel plane mirror open resonator shown in FIG. 1. The frequency band width of a filter is inversely proportional to the Q value of a resonator. The open resonator according to this invention with a high Q value can be used for a filter having a very narrow frequency band and very low insertion loss. A Q value-variable open resonator can be used for a tunable frequency filter with a variable band width. The Q value-variable open resonator for a filter has basically the same structure as that of the aforesaid Fabry-Perot wavelength meter which can, as required, be varied in its finesse F. (FIG. 17). Specifically, it consists of two polarized reflecting surfaces each constituted of conductor stripes with high electrical conductivity, the two mirror surfaces being placed face to face on a common optical axis (FIG. 18). The transmission characteristics of the filters with different Q values for the frequency of electromagnetic waves are schematically shown in FIGS. 19(*a*) and 19(*b*), in which a horizontal axis represents the frequency and a vertical axis represents the transmission coefficient. By varying the difference angle $\theta$, there can be obtained broad transmission band characteristics for a large difference angle $\theta$, as indicated by reference numeral 70 in FIG. 19(*a*). On the other hand, when the difference angle $\theta$ is set small, there can be obtained filter characteristics as indicated by the narrow transmission band characteristics 71 in FIG. 19(*b*). FIG. 20 shows the spectral characteristics of signals to be filtered. The broad transmission band characteristics 70 can be used for detection of the broad band signal 72 of FIG. 20(*a*). On the other hand, where it is necessary to separate a narrow band signal as denoted by reference numeral 73 in FIG. 20(*b*) from other unrequired (or spurious) signals 74, the narrow transmission band characteristics 71 can be used and low insertion loss is assured by selecting the resonance frequency very near the narrow band signal 73. Thus by constituting the open resonator filter using reflecting mirrors consisting of parallel conductor stripe surfaces together with an arrangement which enables adjustment of the angle difference between the directions of the conductor stripes of the two reflecting mirrors, it becomes possible to realize a Q value-variable filter which not only exhibits frequency selection characteristics but also is highly advantageous in that the Q value can be varied according to the signal frequency band.

As will be understood from the foregoing description, the open resonator according to this invention can be made to have an ultra-high Q value together with a high excitation efficiency of the resonator mode and, moreover, this Q value can be made variable. As a result it can overcome the difficulties encountered in the past in the high precision measurement of the material constants of ultra-low loss materials and enables the high-sensitivity detection of trace components in the atmosphere.

What is claimed is:

1. An open resonator for electromagnetic waves comprising:

a pair of reflecting mirrors placed on a common optical axis so as to form a resonant structure, at least one mirror of said pair of reflecting mirrors being spherical, each mirror of said pair of reflecting mirrors having a center portion provided with a circular coupling region having a diameter substantially the same as or slightly smaller than a diameter of a beam of incident electromagnetic waves propagating in a resonant mode on said reflecting mirrors; and a plurality of conductor stripes disposed in parallel to each other in each of said circular coupling regions, said parallel stripes being arranged at intervals of 1/20 to 1/500 of a wavelength of said incident electromagnetic waves propagating in said open resonator said plurality of conductor stripes in one of said circular coupling regions, which is on an input side mirror of said pair of reflecting mirrors, being disposed in parallel to a plane of polarization of said incident electromagnetic wave.

2. An open resonator according to claim 1 wherein said pair of reflecting mirrors are a pair of spherical mirrors.

3. An open resonator according to claim 1, wherein at least one mirror of said pair of reflecting mirrors is supported to be rotatable about said common optical axis.

4. An open resonator according to claim 1, wherein said plurality of conductor stripes are constituted of a substance which exhibits low surface resistance for said incident electromagnetic wave.

5. An open resonator according to claim 4, wherein said plurality of conductor stripes are made of gold or aluminum.

6. An open resonator according to claim 4, wherein said plurality of conductor stripes are made of a superconducting material.

7. An open resonator according to claim 1, wherein at least one mirror of said pair of reflecting mirrors is supported to be movable in order to change a space between said pair of reflecting mirrors.

8. An open resonator according to claim 1, wherein a ratio of a void content of each of said circular coupling regions to said plurality of conductor stripes is in a range of 20%, to 80%.

* * * * *

UNITED STATES PATENT AND TRADEMARK OFFICE

CERTIFICATE OF CORRECTION

PATENT NO. : 5,012,212

DATED : April 30, 1991

INVENTOR(S) : Toshiaki Matsui et al.

It is certified that error appears in the above-identified patent and that said Letters Patent is hereby corrected as shown below:

On the title page, item [73]:

The assignee is incorrect, should be, --Communications Research Laboratory Ministry of Posts and Telecommunications, Koganei, Japan--.

Signed and Sealed this

Sixth Day of October, 1992

*Attest:*

*Attesting Officer*

DOUGLAS B. COMER

*Acting Commissioner of Patents and Trademarks*